US006345581B2

(12) United States Patent
Blanchard

(10) Patent No.: US 6,345,581 B2
(45) Date of Patent: Feb. 12, 2002

(54) MODULAR PONTOON BOATS

(75) Inventor: Clarence E. Blanchard, Pleasant Prairie, WI (US)

(73) Assignee: Outboard Marine Corporation, Waukegan, IL (US)

( * ) Notice: Subject to any disclaimer, the term of this patent is extended or adjusted under 35 U.S.C. 154(b) by 0 days.

(21) Appl. No.: 09/316,582

(22) Filed: May 21, 1999

(51) Int. Cl.[7] ..... B63B 3/08; B63B 1/21

(52) U.S. Cl. ..... 114/61.1; 114/77 R; 114/85; 114/292; 114/352

(58) Field of Search ..... 114/65 R, 77 R, 114/352, 61.1, 85, 292; 441/44; 405/1, 2; 29/429, 430

(56) References Cited

U.S. PATENT DOCUMENTS

| | | | | | |
|---|---|---|---|---|---|
| 2,337,101 | A | * | 12/1943 | Harris | 405/1 |
| 4,829,926 | A | * | 5/1989 | Voelkel | 114/352 |
| 4,856,446 | A | * | 8/1989 | Herard | 114/352 |
| 4,892,052 | A | * | 1/1990 | Zook et al. | 114/85 |
| 5,540,169 | A | * | 7/1996 | Davis et al. | 114/352 |
| 5,803,007 | A | | 9/1998 | Stevens | |

* cited by examiner

*Primary Examiner*—Sherman Basinger
(74) *Attorney, Agent, or Firm*—Armstrong Teasdale LLP

(57) ABSTRACT

A modular pontoon boat including a modular deck and modular pontoons is described. The modular deck includes interlocking portions. Each modular pontoon includes interlocking sections having locks and keys. The modular pontoon boat enables the length of the boat to be selected at the time of assembly, rather than fabrication.

42 Claims, 5 Drawing Sheets

MODULAR PONTOON BOATS

BACKGROUND OF THE INVENTION

This invention relates generally to pontoon boats and, more particularly, to modular pontoon boats.

Typical pontoon boats include two pontoons having a fixed length. That is, once the pontoon is fabricated, the pontoon length cannot be altered. A deck which extends over the pontoons also has a fixed length. Due to consumer preferences, a variety of pontoon boats having different lengths are fabricated and sold. A pontoon boat fabricator therefore must have a variety of molds and also must build, for inventory, many different length pontoons and decks. In addition to the costs associated with maintaining an inventory of different length pontoons and decks, a large work area is required to assemble the boats due to the length of the pontoons and decks.

It would be desirable to provide pontoons and decks which can have lengths selected at the time of assembly rather than fabrication. It also would be desirable to provide pontoon boats which can be quickly and easily assembled in a small area.

BRIEF SUMMARY OF THE INVENTION

These and other objects may be attained by pontoon boats including modular pontoons and modular decks assembled from pontoon sections and deck sections that form pontoons and decks of selected lengths. More particularly, and in an exemplary embodiment, the modular deck includes a bow section, a stern section, and a plurality of center sections. The bow, stern and center sections are interconnected by a flange and groove arrangement. The length of the deck can be altered by varying the number of center, or intermediate, sections.

The modular pontoons also include a bow section, a stern section, and a plurality of center, or intermediate, sections interconnected by a lock and a key arrangement. As with the deck, the pontoon length can be altered by varying the number of center sections.

During assembly, a pontoon bow section is connected to a pontoon center section by positioning the pontoon center section lock over the pontoon bow section key. The pontoon center section is lowered so that the bow section key fits into the center section lock. Another pontoon is assembled in a similar manner. A deck bow section is then connected to the pontoon bow sections and center sections by locating the deck bow section over the pontoon sections. The deck bow section is lowered so that flanges of the pontoon sections extend into a saddle area formed in a bottom of the deck bow section. The pontoon sections are then secured to the deck bow section.

A pontoon center section is added to the assembled portion of each pontoon by fitting the lock of the center section onto the key of the adjacent assembled pontoon sections. The deck center section is located over the pontoon center sections and a flange of the deck center section is positioned within a groove of the adjacent assembled deck section. The deck center section is lowered so that flanges of the pontoon sections extend into a saddle area formed in a bottom of the deck center section. The deck center section is then secured to the pontoon sections. The deck center section is also secured to the adjacent assembled deck section.

Additional pontoon center sections and deck center sections are added to the assembled portion of the pontoons and deck until the assembled portion reaches a selected length. A pontoon stern section is then positioned onto the assembled portion of each pontoon and a deck stern section is positioned onto the pontoon portions. The deck stern section is secured to the adjacent deck center section and to the pontoon stern sections.

The modular deck sections and the modular pontoon sections enable a boat dealer and others, to assemble pontoons and decks of various lengths selected at the time of assembly, rather than requiring that pontoons and decks of fixed lengths be stored in inventory. In addition, the pontoons and decks can be easily and quickly assembled.

DETAILED DESCRIPTION OF THE INVENTION

Figure 1:
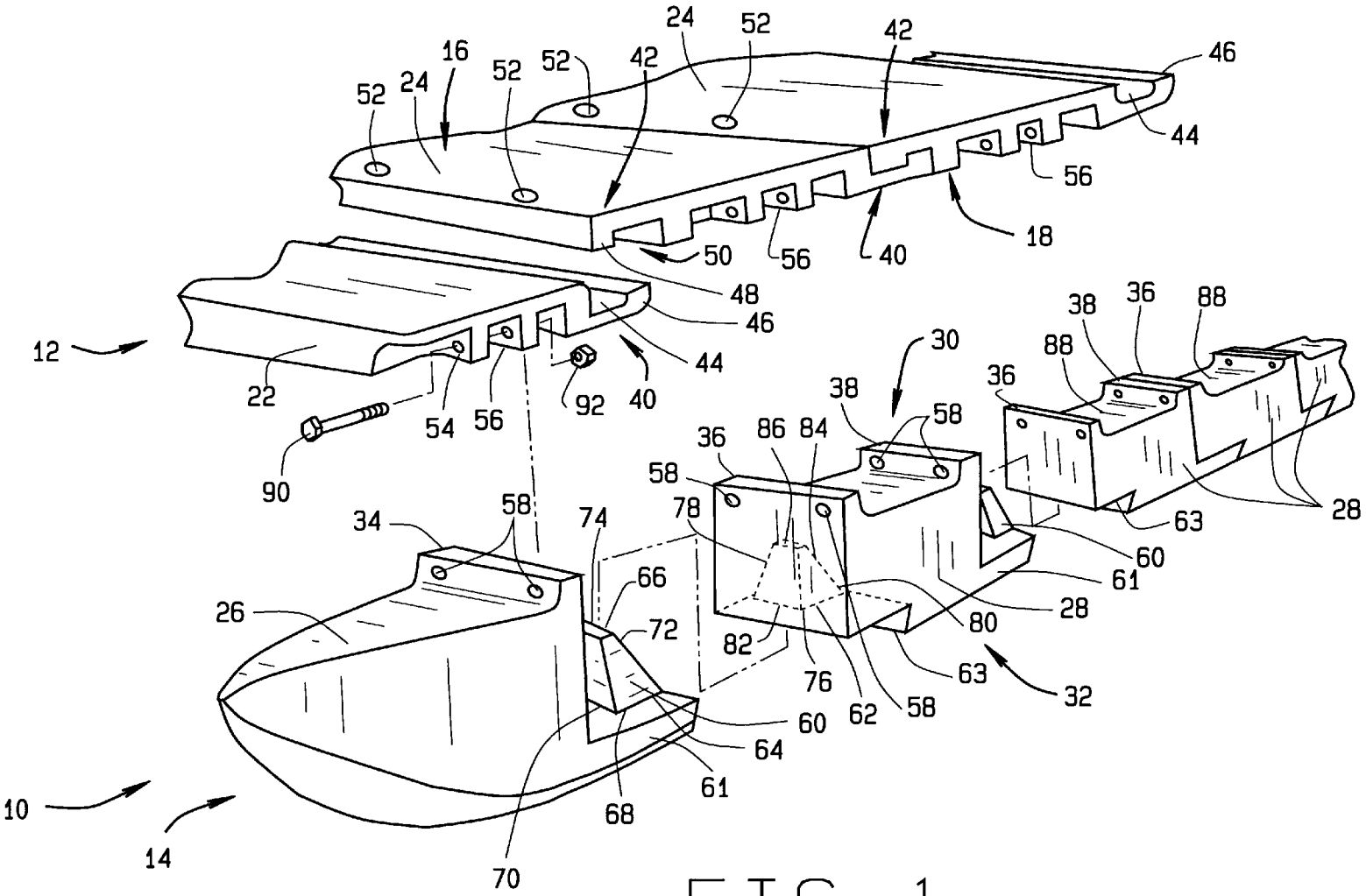
FIG. 1 is a partially exploded view of a modular deck and a modular pontoon for a modular pontoon boat.

FIG. 1 illustrates a partially exploded view of a modular pontoon boat 10 including a modular deck 12 and a plurality of modular pontoons 14. Modular deck 12 includes a top 16 and a bottom 18 which extend from a port side 20 to a starboard side (not shown in FIG. 1) of boat 10. Modular deck 12 further includes a bow section 22, a plurality of deck center sections 24, and a stern section (not shown in FIG. 1).

Modular pontoon 14 includes a bow section 26, a plurality of pontoon center sections 28, and a stern section (not shown in FIG. 1). Modular pontoon 14 further includes a top 30 and a bottom 32. Top 30 of pontoon bow section 26 includes a first flange 34. In addition, top 30 of pontoon center sections 28 and the pontoon stern section each include a second flange 36 and a third flange 38.

Top 16 of deck bow section 22 and deck center sections 24 each include an interlock portion 40. Bottom 18 of deck center sections 24 and the deck stern section each include an interlock portion 42. Top interlock portion 40 includes a groove 44 adjacent a flange 46 on top 16 of deck bow section 22 and deck center sections 24. Bottom interlock portion 42 includes a flange 48 adjacent a groove 50 on bottom 18 of deck center sections 24 and the deck stern section. Each bottom interlock portion 42 is configured to engage a respective top interlock portion 40.

A plurality of interlock openings 52 extend through bottom interlock portion 42 in deck center sections 24 and the deck stern section. A plurality of fasteners (not shown) extend through openings 52 and secure interlock bottom portion 42 to interlock top portion 40 as described below in greater detail.

Deck bottom 18 includes saddle openings 54 which extend through a first saddle area 56 and a second saddle area (not shown in FIG. 1). Two pontoon openings 58 extend through each of first flange 34, second flange 36, and third flange 38. In one embodiment, flanges 34, 36 and 38 include one, three, or more pontoon openings. Pontoon openings 58 align with saddle openings 54 when pontoon sections 26 and 28 engage deck bottom 18. Pontoon openings 58 and saddle openings 54 are circular openings. In an alternative embodiment, pontoon openings 58 and saddle openings 54 are oval or elliptical, depending on the fastener utilized therewith.

Pontoon bow section 26 and pontoon center sections 28 each include a key 60 formed on a ledge 61 extending from a bottom 32 of an aft portion of pontoon sections 26 and 28. Pontoon center sections 28 and the pontoon stern section each include a lock 62 formed in a forward portion of center sections 28 and the stern section. Pontoon center sections 28 and the pontoon stern section also each include a notch 63 on bottom 32 of the forward portion. Each ledge 61 and key 60 engage a respective notch 63 and lock 62, respectively, when modular pontoon 14 is assembled, as described below in greater detail.

Pontoon key 60 includes a wedge shaped protrusion having a base 64 and a top 66. Base 64 includes a length 68 and a width 70 and top 66 includes a length 72 and a width 74. Width 70 and length 68 of base 64 are larger than width 74 and length 72 of top 66. Pontoon key 60 extends from pontoon ledge 61 towards pontoon top 30. Pontoon lock 62 includes a wedge shaped opening having a base 76 and a top 78. Lock base 76 includes a length 80 and a width 82 and lock top 78 includes a length 84 and a width 86. Length 80 and width 82 of lock base 76 are larger than length 84 and width 86 of lock top 78. Pontoon lock 62 diminishes in size as lock 62 extends from notch 63 towards top 30.

In an alternative embodiment, pontoon key 60 has other shapes that permit pontoon key 60 to fit within pontoon lock 62 and lock adjacent pontoon sections in a fore and aft direction. In addition, pontoon key 60 is shaped to locate vertically within pontoon lock 62.

Pontoon center sections 28 and the pontoon stern section further include a channel 88. Channel 88 separates second pontoon flange 36 from third pontoon flange 38.

Modular pontoon 14 is assembled by positioning pontoon center section lock 62 over pontoon bow section key 60. Pontoon center section 28 is lowered so that key 60 fits into lock 62 and ledge 61 fits within notch 63. A second pontoon is assembled in a similar manner. Deck bow section 22 is then located above pontoon bow sections 26 and center sections 28. Deck bow section 22 is lowered so that flanges 34 and 36 of pontoon sections 26 and 28, respectively, extend into saddle area 56 of deck bow section 22. Pontoon sections 26 and 28 are then secured to the deck bow section 22 with a pair of bolts 90 (only one bolt 90 is shown) and a pair of nuts 92 (only one nut 92 is shown).

Pontoon center sections 28 are connected to the assembled portion of each pontoon 14 by fitting lock 62 of center section 28 onto key 60 of an adjacent center section 28. Deck center section 24 is located over pontoon center sections 28 and flange 48 of deck center section 24 is positioned within groove 44 of deck bow section 22. Deck center section 24 is lowered so that adjacent flanges 38 and 36 of pontoon sections 28 extend into saddle area 56 in bottom 18 of deck center section 24. Deck center section 24 is then secured to pontoon sections 28 with bolts 90 and nuts 92. Deck center section 24 is also secured to deck bow section 22 with a plurality of fasteners (not shown). The fasteners extend through openings 52 in deck center section 24 and into a plurality of openings (not shown) in deck bow section 22. Additional pontoon center sections 28 and deck center sections 24 are added to the assembled portion of pontoons 14 and deck 12 until the assembled portion reaches a selected length. A pontoon stern section (not shown in FIG. 1) is then positioned onto the assembled portion of each pontoon and a deck stern section (not shown in FIG. 1) is positioned onto the pontoon stern portions. The deck stern section is secured to adjacent deck center section 24 with fasteners (not shown). The deck stern section is secured to the pontoon stern sections with bolts 90 and nuts 92.

Figure 2:
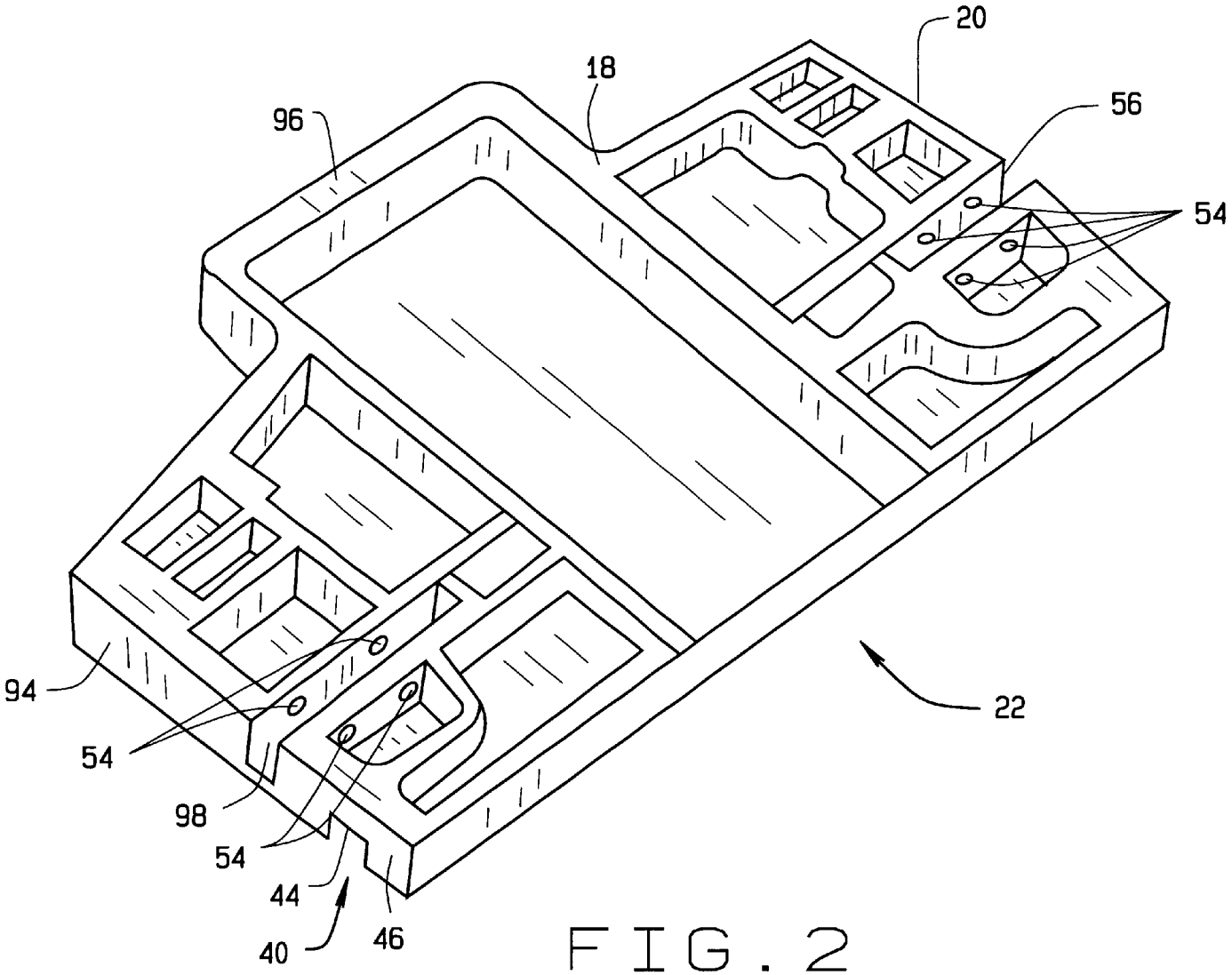
FIG. 2 is a bottom perspective view of a deck bow section of the modular deck shown in FIG. 1.

FIG. 2 illustrates a bottom view of deck bow section 22 including a starboard side 94 and a bow 96. Bow 96 is located between port side 20 and starboard side 94. Deck bottom 18 of bow section 22 includes first saddle area 56 on port side 20 and a second saddle area 98 on starboard side 94. Saddle areas 56 and 98 each include four saddle openings 54. In an alternative embodiment, saddle areas 56 and 98 each include two, six, or more saddle openings. Saddle openings 54 are arranged in pairs such that a single bolt 90 (shown in FIG. 1) can extend through two saddle openings 54.

Deck bow section 22 is attached to a first pontoon bow section 26 (shown in FIG. 1) and center section 28 (shown in FIG. 1) by inserting pontoon flanges 34 and 36 into first saddle area 56. Deck bow section 22 is also attached to a second pontoon bow section 26 and center section 28 by inserting pontoon flanges 34 and 36 into second saddle area 98. Pontoon openings 58 are aligned with saddle openings 54 as flanges 34 and 36 are inserted into saddle areas 56 and 98. Bolts 90 and nuts 92 (shown in FIG. 1) secure deck bow section 22 to pontoon bow sections 26 and center sections 28.

Figure 3:
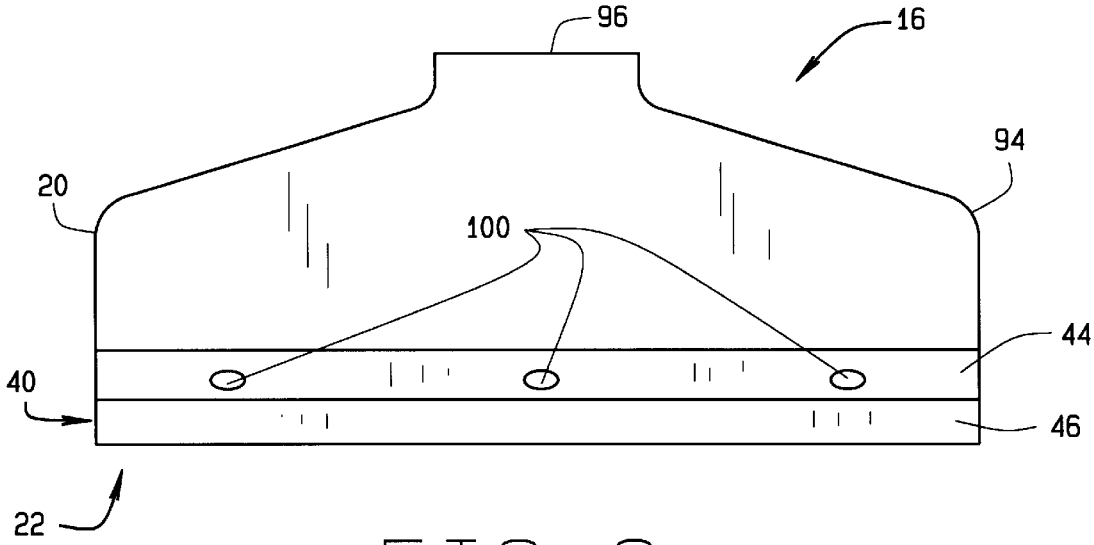
FIG. 3 is a top view of the deck bow section shown in FIG. 2.

FIG. 3 illustrates top 16 of deck bow section 22 further including a plurality of top interlock openings 100 which extend through top interlock portion 40 at groove 44. Top interlock openings 100 are circular openings which align with bottom interlock openings 52 (shown in FIG. 1) when top interlock portion 40 engages bottom interlock portion 42 (shown in FIG. 1). In an alternative embodiment, top interlock openings 100 can be any shape such as square, oval, or elliptical. Groove 44 and flange 46 form top interlock portion 40 which extends from port side 20 to starboard side 94 in deck top 16. Fasteners (not shown) extend through openings 52 and 100 to secure deck bow section 22 to center section 24 (shown in FIG. 1).

In an alternate embodiment, the top interlock openings extend partially through top interlock portion 40. Fasteners then extend through openings 52 and into the top interlock openings to secure deck bow section 22 to center section 24.

Figure 4:
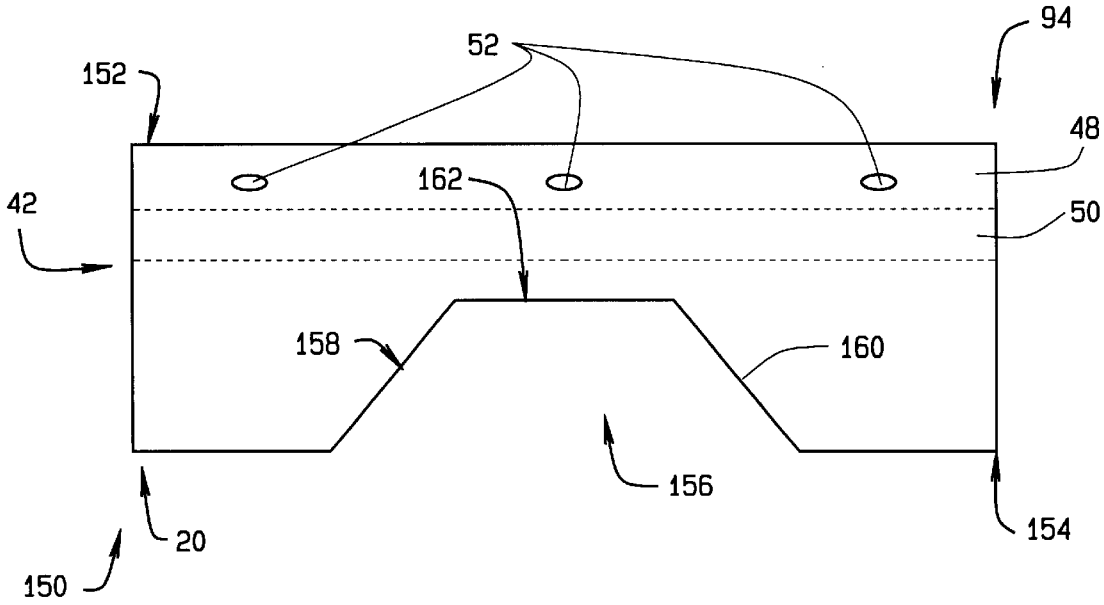
FIG. 4 is a top view of a stern section of the modular deck shown in FIG. 1.

FIG. 4 illustrates a deck stern section 150 including top 16, a front 152, and a back 154. A notch 156 extends from back 154 towards front 152, and includes a first side 158, a second side 160, and a notch front 162. Sides 158 and 160 are angled from back 154 to notch front 162 and notch 156 is larger at back 154 than at notch front 162. Notch 156 receives a motor mount (not shown) and a motor (not shown) as is well known in the art.

Groove 50 and flange 48 form bottom interlock portion 42 which extends from port side 20 to starboard side 94 of deck bottom 18. Bottom interlock portion 42 includes bottom interlock openings 52, which are circular openings. In an alternative embodiment, bottom interlock openings 52 can be any shape such as square, oval, or elliptical. Bottom interlock openings 52 align with top interlock openings (not shown) in an adjacent deck center section 24 (shown in FIG.

1) when bottom interlock portion 42 engages top interlock portion 40. Fasteners (not shown) secure deck stern section 150 to center section 24.

Figure 5:
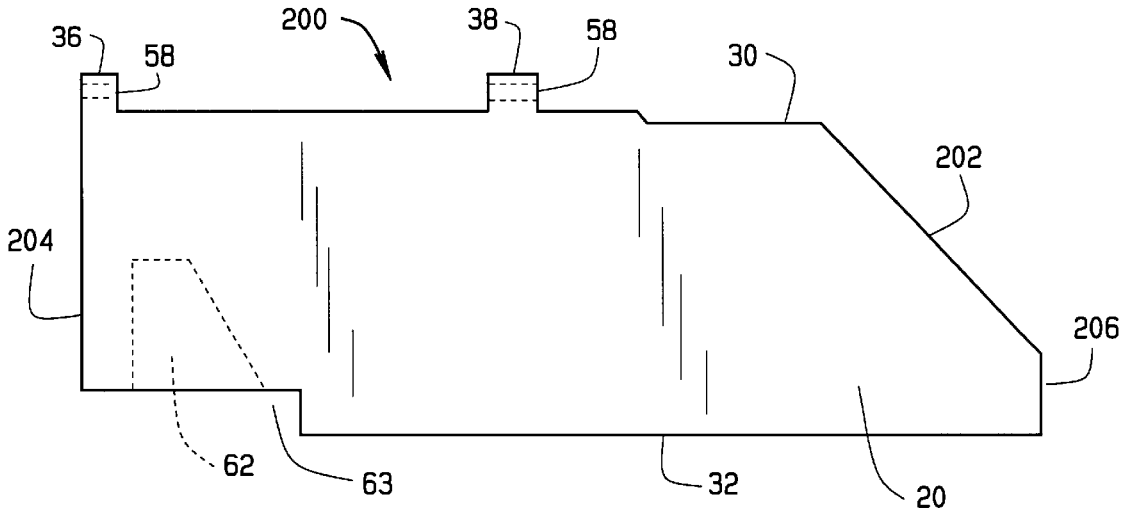
FIG. 5 is a side view of a stern section of the modular pontoon shown in FIG. 1.

FIG. 5 illustrates port side 20 of a pontoon stern section 200 including a ladder 202 extending from pontoon top 30 towards pontoon bottom 32. Pontoon stern section 200 further includes a forward end 204 and an aft end 206. Ladder 202 slopes towards aft end 206 as it extends from pontoon top 30 towards pontoon bottom 32.

Second flange 36 and third flange 38 of pontoon stern section 200 engage a saddle area (not shown) of deck stern section 150 (shown in FIG. 4) when deck stern section 150 is positioned onto pontoon stern section 200. Pontoon openings 58 align with saddle openings 54 (shown in FIG. 1) when flanges 36 and 38 engage the saddle area. Pontoon lock 62 engages a pontoon key 60 (shown in FIG. 1) of an adjacent pontoon center section 28 when pontoon stern section 200 is assembled onto pontoon center section 28. Notch 63 accommodates ledge 61 (shown in FIG. 1) of pontoon center section 28 when lock 62 engages key 60 of center section 28. Bolts 90 (shown in FIG. 1) and nuts 92 (shown in FIG. 1) are utilized to secure pontoon stern section 200 to deck stern section 150 (shown in FIG. 4) after pontoon stern section 200 is locked onto pontoon center section 28.

Figure 6:
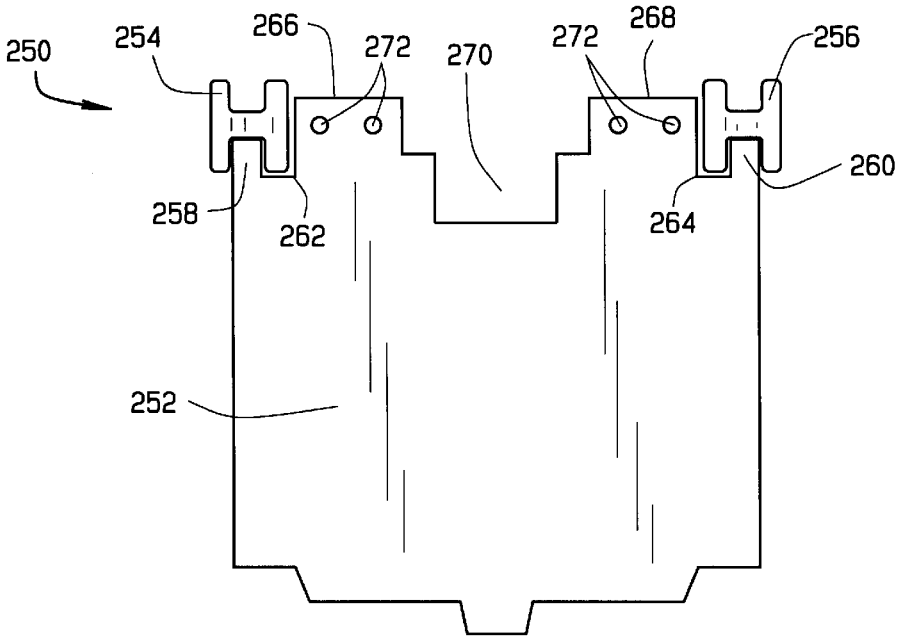
FIG. 6 is an end view of a center section of the modular pontoon shown in FIG. 1.

FIG. 6 illustrates an alternative embodiment of a pontoon center section 250 including a forward end 252, a first rubber trim insert 254, a second rubber trim insert 256, a first side flange 258 and a second side flange 260. Pontoon center section 250 also includes a first groove 262 adjacent first side flange 258 and a second groove 264 adjacent second side flange 260. Pontoon center section 250 further includes a first central flange 266, a second central flange 268, and a channel 270 separating flange 266 from flange 268. Central flanges 266 and 268 each include a pair of openings 272. In an alternative embodiment, central flanges 266 and 268 each include one, three, or more openings 272.

Prior to attaching pontoon center section 250 to pontoon boat 10 (shown in FIG. 1), first rubber trim insert 254 is positioned on first side flange 258 and within first groove 262, and second rubber trim insert 256 is positioned on second side flange 260 and within second groove 264. Rubber trim inserts 254 and 256 provide styling to pontoon section 250 and also reduce the amount of water that enters channel 270. Channel 270 extends along a length of pontoon center section 250 and is utilized to carry wiring and other elements below modular deck 12 (shown in FIG. 1).

Pontoon center section 250 is attached to deck center section 24 (shown in FIG. 1) by positioning deck center section 24 above pontoon center section 250 and aligning openings 272 with saddle openings 54 (shown in FIG. 1). Deck center section 24 is then lowered onto pontoon center section 250 and fasteners (not shown) are positioned through openings 272 and 54 to secure pontoon center section 250 to deck center section 24.

Figure 7:
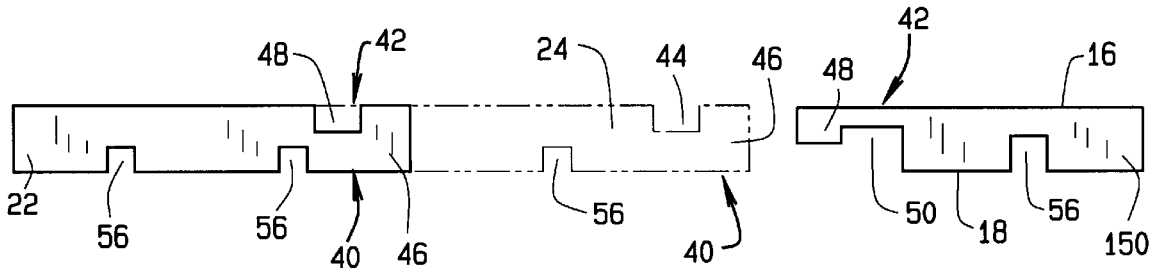
FIG. 7 is a side view of a portion of the modular deck shown in FIG. 1 being assembled.

FIG. 7 illustrates deck bow section 22, deck center section 24, and deck stern section 150 being assembled into modular deck 12 (shown in FIG. 1). Deck sections 22 and 24 are assembled by engaging top interlock portion 40 of deck bow section 22 with bottom interlock portion 42 of deck center section 24. Specifically, flange 46 of bow section 22 is inserted into groove 50 of center section 24 while flange 48 of center section 24 is inserted into groove 44 of bow section 22. Fasteners (not shown) secure deck bow section 22 to center section 24.

Additional deck center sections 24 are attached to deck 12 until a selected length is attained. Deck stern section 150 is then attached to an adjacent deck center section 24 by engaging top interlock portion 40 of deck center section 24 with bottom interlock portion 42 of deck stern section 150. Fasteners (not shown) secure deck center section 24 to stern section 150.

Figure 8:
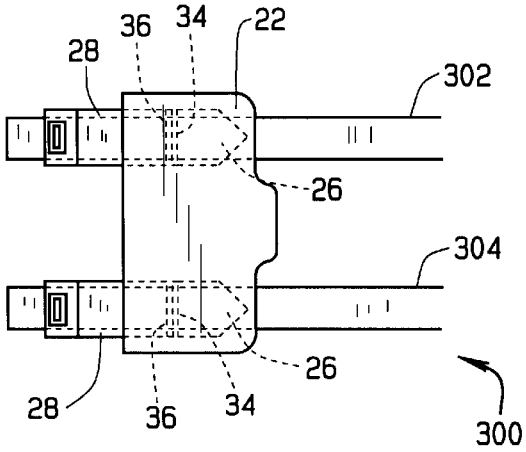
FIG. 8 is a top view of an assembly track.

FIG. 8 illustrates an assembly track 300 for assembling modular pontoon boat 10 (shown in FIG. 1). Assembly track 300 includes a first row of rollers 302 and a second row of rollers 304. First row 302 is substantially parallel to second row 304. A first pontoon bow section 26 is positioned on first row 302 and a second pontoon bow section 26 is positioned on second row 304. A first pontoon center section 28 is locked onto first pontoon bow section 26 as first pontoon center section 28 is placed on first row of rollers 302. A second pontoon center section 28 is locked onto second pontoon bow section 26 as second pontoon center section 28 is placed on second row of rollers 304.

A deck bow section 22 is positioned above assembled pontoon sections 26 and 28. Deck bow section 22 is lowered onto pontoon sections 26 and 28 so that flanges 34 and 36 of sections 26 and 28 extend into saddle areas 56 and 98 (shown in FIG. 2) of deck bow section 22.

Deck bow section 22 is then attached to pontoon sections 26 and 28 by aligning pontoon openings 58 (shown in FIG. 1) with saddle openings 54 (shown in FIG. 1). Nuts 90 (shown in FIG. 1) and bolts 92 (shown in FIG. 1) are utilized to secure deck bow section 22 to pontoon sections 26 and 28.

The assembled sections 26, 28, and 22 are then rolled forward on track 300 and a first additional pontoon center section (not shown) is locked onto assembled pontoon center section 28 as the additional pontoon center section is positioned on first row of rollers 302. A second additional pontoon center section (not shown) is locked onto assembled pontoon center section 28 as the second additional pontoon center section is positioned on second row of rollers 304.

A deck center section (not shown) is positioned above assembled pontoon sections 28 and adjacent deck bow section 22. The deck center section is lowered onto pontoon sections 28 so that the flanges (not shown) of pontoon sections 28 extend into saddle areas (not shown) of the deck center section. The deck center section is then attached to pontoon sections 28 with nuts 90 (shown in FIG. 1) and bolts 92 (shown in FIG. 1).

Additional pontoon center sections (not shown) and additional deck center sections (not shown) are assembled in a similar manner until a selected length is attained. A pontoon stern section (not shown) is then attached to each assembled pontoon portion and a deck stern section (not shown) is then attached to the assembled pontoon sections.

In one embodiment, pontoon bow section 26 and the pontoon stern section have a length of about three feet. Pontoon center section 28 has a length of about 2 feet. In addition, deck bow section 22 and the deck stern section have a length of about two to about four feet, and deck center section 24 has a length of about two feet. Modular decks and modular pontoon can thus be fabricated having various lengths. The lengths of both the deck and the pontoons will vary in two feet increments.

Three pontoon molds, a pontoon bow mold, a pontoon center mold, and a pontoon stern mold, are utilized for the molding of the pontoon sections. Additionally, three deck molds, a deck bow mold, a deck center mold, and a deck stern mold, are utilized for the molding of the deck sections.

Modular deck 12 and modular pontoon 14 are fabricated by rotational molding utilizing polyethylene. The method for rotational molding the sections includes the step of adding polyethylene pellets to the molds. The molds are then heated to a temperature of about 400° F. for about 20 minutes. Thereafter, the molds are cooled, for example with cooling fans or with water mist. The molded section is then removed from the mold and the method is repeated.

A modular pontoon boat is fabricated utilizing three deck sections, bow, center, and stern, and three pontoon sections, bow, center, and stern. Boats of various lengths can be fabricated from these sections simply by altering the number of center sections of both the deck and the pontoons. The boat manufacturer can thus reduce fabrication costs by stocking only six sectional components that can be utilized to fabricate virtually any length pontoon boat. In addition, due to the rotational molding of the sections, the pontoon sections can be utilized for storage. In one embodiment, the pontoon stern section is utilized as a fuel tank, and the pontoon bow section is utilized as a fresh water tank.

From the preceding description of various embodiments of the present invention, it is evident that the objects of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A pontoon boat comprising:

a modular deck comprising a bow section, a stern section, and at least one center section, said bow section and said stern section connected to said at least one center section, said deck comprising saddle areas and a plurality of saddle openings extending through said saddle areas; and a modular pontoon comprising:

a pontoon bow section, a top of said pontoon bow section comprising a first pontoon flange;

a pontoon stern section; and at least one pontoon center section, a top of said pontoon center section and a top of said pontoon stern section each comprising a second pontoon flange and a third pontoon flange, said pontoon flanges comprising a plurality of pontoon flange openings and configured to engage said saddle areas of a bottom of said deck, said pontoon flange openings configured to align with said saddle openings, said pontoon bow section and said pontoon stern section connected to said at least one pontoon center section.

2. A pontoon boat in accordance with claim 1 wherein said deck further comprises:

a first plurality of openings extending through a top interlock portion; and a second plurality of openings extending through a bottom interlock portion, said second plurality of openings configured to align with said first plurality of openings.

3. A pontoon boat in accordance with claim 1 wherein said pontoon bow section and said pontoon center section each comprise a pontoon key, said pontoon stern section and said pontoon center section each comprise a pontoon lock, each said pontoon lock configured to engage a respective said pontoon key.

4. A pontoon boat in accordance with claim 1 wherein said pontoon and said deck comprise rotational molded sections.

5. A method for assembling a pontoon boat, the pontoon boat including a deck and a plurality of pontoons, the deck including a deck bow section, a plurality of deck center sections, and a deck stern section, each pontoon including a pontoon bow section, a plurality of pontoon center sections, and a stern section, said method comprising the steps of:

placing a first pontoon bow section on a first assembly rail;

placing a second pontoon bow section on a second assembly rail;

positioning a first pontoon center section in contact with the first pontoon bow section on the first assembly rail;

positioning a second pontoon center section in contact with the second pontoon bow section on the second assembly rail; and placing the deck bow section over the pontoon bow sections and the pontoon center sections.

6. A method in accordance with claim 5 further comprising the steps of:

positioning a first additional pontoon center section in contact with the pontoon center section on the first rail;

positioning a second additional pontoon center section in contact with the pontoon center section on the second rail; and placing a first deck center section onto the pontoon center sections and in contact with the deck bow section.

7. A method in accordance with claim 6 further comprising the steps of:

positioning a first further additional pontoon center section in contact with the first additional pontoon center section on the first rail;

positioning a second further additional pontoon center section in contact with the second additional pontoon center section on the second rail;

placing an additional deck center section onto the pontoon center sections; and repeating said steps of positioning a further additional pontoon center section and placing an additional deck center section until a selected length is attained.

8. A method in accordance with claim 7 further comprising the steps of:

positioning a first pontoon stem section in contact with the first further additional pontoon center section on the first rail;

positioning a second pontoon stern section in contact with the second further additional pontoon center section on the second rail; and placing the deck stern section onto the pontoon stern sections.

9. A method in accordance with claim 6 wherein the deck bow section and the deck center sections each include a top interlock portion, the deck stern section and the deck center sections each include a bottom interlock portion, the deck sections further include a first plurality of openings extending through the top interlock portions and a second plurality of openings extending through the bottom interlock portions, said step of placing a first deck center section comprises the steps of:

inserting the bottom interlock portion of the first deck center section into the top interlock portion of the deck bow section;

inserting fasteners through the first plurality of openings and the second plurality of openings in the top interlock portion and the bottom interlock portion, respectively; and securing the fasteners in the interlock portions.

10. A method in accordance with claim 5 wherein the pontoon bow sections and the pontoon center sections include a pontoon key, the pontoon stern sections and the pontoon center sections include a pontoon lock, said steps of positioning the pontoon center sections further comprise the step of:

inserting the pontoon key of the pontoon bow section into the pontoon lock of the pontoon center section.

11. A method for assembling a pontoon boat, the pontoon boat including a deck and two pontoons, the deck including a deck bow section, a plurality of deck center sections, and a deck stem section, each pontoon including a pontoon bow section, a plurality of pontoon center sections, and a pontoon stem section, the pontoon bow and center sections including a key, and the pontoon center sections and the pontoon stem section including a lock, said method comprising the steps of:

positioning the lock of a first pontoon center section above the key of a first pontoon bow section;

lowering the first pontoon center section so that the first bow section key fits within the first center section lock, thereby locking the first pontoon center section to the first pontoon bow section;

positioning the lock of a second pontoon center section above the key of a second pontoon bow section; and lowering the second pontoon center section so that the second bow section key fits within the second center section lock, thereby locking the second pontoon center section to the second pontoon bow section.

12. A method in accordance with claim 11 wherein each pontoon section includes at least one flange and each deck section includes two saddle areas, said method further comprising the steps of:

positioning the deck bow section above the locked pontoon sections;

lowering the deck bow section onto the locked pontoon sections;

positioning a first pair of pontoon flanges within a deck bow section first saddle area;

positioning a second pair of pontoon flanges within a deck bow section second saddle area; and fastening the first and second pair of flanges to the first and second deck bow section saddle areas, respectively.

13. A method in accordance with claim 12 further comprising the steps of:

positioning the lock of a first additional pontoon center section above the key of the first pontoon center section;

lowering the first additional pontoon center section so that the first pontoon center section key fits within the first additional pontoon center section lock, thereby locking the first additional pontoon center section to the first pontoon center section;

positioning the lock of a second additional pontoon center section above the key of the second pontoon center section; and lowering the second additional pontoon center section so that the second pontoon center section key fits within the second additional pontoon center section lock, thereby locking the second additional pontoon center section to the second pontoon center section.

14. A method in accordance with claim 13 wherein the deck bow section and the deck center section each include a top interlock portion and the deck center section and the deck stern section each include a bottom interlock portion, said method further comprising the steps of:

positioning a deck center section above the locked center pontoon sections;

lowering the deck center section onto the locked pontoon sections;

engaging the top interlock portion of the deck bow section with the bottom interlock portion of the deck center section;

positioning a first pair of pontoon center section flanges within a deck center section first saddle area;

positioning a second pair of pontoon center section flanges within a deck center section second saddle area;

fastening the top interlock portion of the deck bow section to the bottom interlock portion of the deck center section; and fastening the first and second pair of pontoon center section flanges to the first and second deck center section saddle areas, respectively.

15. A method in accordance with claim 14 further comprising the steps of:

positioning the lock of a first pontoon stern section above the key of the first additional pontoon center section;

lowering the first pontoon stern section so that the first additional center section key fits within the first stern section lock;

positioning the lock of a second pontoon stern section above the key of the second additional pontoon center section; and lowering the second pontoon stern section so that the second additional center section key fits within the second stern section lock.

16. A method in accordance with claim 15 further comprising the steps of:

positioning a deck stern section above the locked pontoon center sections;

lowering the deck stern section onto the locked pontoon sections;

engaging the top interlock portion of the deck center section with the bottom interlock portion of the deck stern section;

positioning a first pontoon stern section flange within a deck stern section first saddle area;

positioning a second pontoon stern section flange within a deck stern section second saddle area;

fastening the deck center section top interlock portion to the deck stern section bottom interlock portion; and fastening the first and second pontoon stern section flanges to the first and second deck stern section saddle areas, respectively.

17. A method for fabricating a pontoon boat, the pontoon boat including a deck connected to a plurality of pontoons, said method comprising the steps of:

fabricating a deck bow section, at least one deck center section, and a deck stem section; and fabricating a plurality of pontoon bow sections, a plurality of pontoon center sections, and a plurality of pontoon stem sections, each deck section configured to connect to one another, each of the pontoon sections including a flange having at least one opening therethrough for coupling the deck sections to the pontoon sections.

18. A method in accordance with claim 17 wherein said step of fabricating a deck bow section, at least one deck center section, and a deck stern section comprises the step of rotational molding the deck sections.

19. A method in accordance with claim 17 wherein said step of fabricating a plurality of pontoon bow sections, a plurality of pontoon center sections, and a plurality of pontoon stern sections comprises the step of rotational molding the pontoon sections.

20. A method in accordance with claim 17 wherein said step of fabricating a deck bow section, at least one deck center section, and a deck stern section comprises the steps of:

fabricating a top interlock portion in the deck bow section and the deck center section, the top interlock portion including a deck top groove adjacent a deck top flange; and fabricating a bottom interlock portion in the deck center section and the deck stern section, the bottom interlock portion including a deck bottom flange adjacent a deck bottom groove.

21. A method in accordance with claim 17 wherein said step of fabricating a plurality of pontoon bow sections, a plurality of pontoon center sections, and a plurality of pontoon stern sections comprises the steps of:

fabricating a pontoon key in the pontoon bow sections and the pontoon center sections, the pontoon key including a wedge shaped protrusion extending from a pontoon bottom towards a pontoon top; and fabricating a pontoon lock in the pontoon center sections and the pontoon stern sections, the pontoon lock including a wedge shaped indentation extending from a pontoon bottom towards a pontoon top.

22. A pontoon section for a boat, the boat including a deck having a saddle area, said pontoon section comprising:

at least one flange for engaging the deck saddle area and configured for coupling the flange to the saddle area;

a top, a first end and a second end;

a lock at said first end; and a notch extending from said first end, said lock extending from said notch, said lock comprises an opening extending from said notch toward said top, said pontoon section configured to mate with an adjacent said pontoon section at one of said first end and said second end.

23. A pontoon section in accordance with claim 22 wherein said opening diminishes in size as it extends from said notch.

24. A pontoon section in accordance with claim 22 further comprising a key at said second end.

25. A pontoon section in accordance with claim 24 further comprising a ledge extending from said second end, said key extending from said ledge.

26. A pontoon section in accordance with claim 25 wherein said key comprises a protrusion extending from said ledge toward said top.

27. A pontoon section in accordance with claim 26 wherein said protrusion diminishes in size as it extends from said ledge.

28. A pontoon section in accordance with claim 26 wherein said protrusion is wedge shaped.

29. A pontoon boat comprising:

at least one pontoon comprising a plurality of interlocking pontoon sections, a length of said pontoon selected by selecting a number of said interlocking sections, said pontoon sections comprising a pontoon bow section, a pontoon stem section, and at least one pontoon center section, said pontoon bow section connected to said at least one pontoon center section which is connected to said pontoon stern section; and a deck comprising a plurality of interlocking sections, said deck sections comprising a deck bow section, a deck stern section, and a deck center section, said deck sections connected to said pontoon sections such that a length of said deck is capable of being altered by altering the number of deck sections.

30. A pontoon boat in accordance with claim 29 wherein said deck sections comprise a deck bow section, a deck stern section, and at least one deck center section, said deck bow section connected to said at least one deck center section which is connected to said deck stern section.

31. A pontoon boat in accordance with claim 30 wherein each said deck section comprises a saddle area having at least one opening therethrough and an interlock portion configured to engage an adjacent said deck section interlock portion.

32. A pontoon boat in accordance with claim 30 wherein each said deck section comprises a saddle area and each said pontoon section comprises at least one flange configured to engage said deck section saddle areas.

33. A pontoon boat in accordance with claim 30 wherein each said pontoon section comprises at least one locking portion.

34. A pontoon boat in accordance with claim 33 wherein said pontoon section locking portion comprises one of a lock and a key, each said pontoon section lock configured to engage an adjacent said pontoon section key.

35. A pontoon boat in accordance with claim 34 wherein said pontoon section lock comprises an opening, said pontoon section key comprises a protrusion, said protrusion configured to extend within said opening.

36. A kit comprising:

a plurality of pontoon sections comprising at least one bow section, at least one stern section, and at least one center section, each said pontoon section configured to be connected to at least one other said pontoon section; and a plurality of deck sections comprising at least one bow section, at least one stem section, and at least one center section, each said deck section configured to be connected to at least one other said deck section, at least one of said deck sections further configured to be connected to at least one of said pontoon sections.

37. A kit in accordance with claim 36 wherein said at least one pontoon bow section configured to lock with said at least one pontoon center section, said at least one pontoon center section configured to lock with said pontoon stern section.

38. A kit in accordance with claim 37 wherein each said pontoon section comprises one of a pontoon lock and a pontoon key, each said pontoon lock configured to engage a respective said pontoon key when said pontoon bow section is connected to said at least one pontoon center section and said at least one pontoon center section is connected to said pontoon stern section.

39. A kit in accordance with claim 38 wherein one of said pontoon lock and said pontoon key comprises a wedge shaped protrusion and the other of said pontoon lock and said pontoon key comprises a wedge shaped opening, said protrusion configured to extend within said opening.

40. A kit in accordance with claim 36 wherein said at least one deck bow section configured to lock with said at least one deck center section, said at least one deck center section configured to lock with said deck stem section.

41. A kit in accordance with claim 40 wherein each said deck section comprises one of a top interlock portion comprising at least one opening therethrough and a bottom interlock portion comprising at least one opening therethrough, each said top interlock portion configured to engage a respective said bottom interlock portion when said deck bow section is connected to said at least one deck center section and said at least one center section is connected to said deck stem section, said at least one opening of said top interlock portion aligned with said at least one opening of said bottom interlock when said deck sections are connected.

42. A kit in accordance with claim 41 further comprising a plurality of bolts, said top interlock portion comprises a first plurality of openings, said bottom interlock portion comprises a second plurality of openings, said first plurality of openings configured to align with said second plurality of openings when said deck bow section is connected to said at least one deck center section and said at least one deck center section is connected to said deck stern section, said bolts configured to extend through said aligned openings.

* * * * *